US008393024B2

(12) United States Patent
Mitchell

(10) Patent No.: US 8,393,024 B2
(45) Date of Patent: Mar. 12, 2013

(54) ADJUSTABLE BED SKIRT

(76) Inventor: E Patricia Mitchell, Braselton, GA (US)

( * ) Notice: Subject to any disclaimer, the term of this patent is extended or adjusted under 35 U.S.C. 154(b) by 45 days.

(21) Appl. No.: 13/219,588

(22) Filed: Aug. 26, 2011

(65) Prior Publication Data

US 2012/0060281 A1 Mar. 15, 2012

Related U.S. Application Data

(60) Provisional application No. 61/377,890, filed on Aug. 27, 2010.

(51) Int. Cl.
*A47G 9/02* (2006.01)

(52) U.S. Cl. ..... 5/493; 5/482

(58) Field of Classification Search ..... 5/493, 482, 5/486, 488, 495, 498, 499
See application file for complete search history.

(56) References Cited

U.S. PATENT DOCUMENTS

| | | | |
|---|---|---|---|
| 3,999,233 | A | 12/1976 | Morris |
| 4,141,097 | A | 2/1979 | Levinsohn |
| 4,587,683 | A | 5/1986 | Gardiner |
| 4,807,316 | A | 2/1989 | Whipple |
| 5,063,626 | A | 11/1991 | Carlos |
| 5,086,531 | A | 2/1992 | Carlos |
| 5,271,112 | A | 12/1993 | Bible et al. |
| 5,638,562 | A | 6/1997 | Masoncup |
| 5,715,553 | A | 2/1998 | Baron et al. |
| 5,749,110 | A | 5/1998 | Gamble et al. |
| 5,966,758 | A | 10/1999 | Karam |
| 6,035,469 | A | 3/2000 | Schroughman |
| 6,151,731 | A | 11/2000 | Sparrow |
| 6,276,009 | B1 | 8/2001 | Schrougham |
| 6,792,632 | B2 | 9/2004 | Cohen |
| 6,925,667 | B2 | 8/2005 | Cohen |
| 6,971,129 | B2 | 12/2005 | Wootten, Jr. et al. |
| 7,093,310 | B2 | 8/2006 | Barros |
| 2003/0028965 | A1 | 2/2003 | Wootten, Jr. et al. |
| 2004/0221389 | A1 | 11/2004 | McClelland |
| 2009/0249550 | A1 | 10/2009 | Henning |
| 2011/0308013 | A1 * | 12/2011 | Kennett ..... 5/493 |

FOREIGN PATENT DOCUMENTS

| | | | |
|---|---|---|---|
| WO | 9903378 | A1 | 1/1999 |
| WO | 2010033555 | A2 | 3/2010 |

* cited by examiner

*Primary Examiner* — Robert G Santos
*Assistant Examiner* — Brittany Wilson
(74) *Attorney, Agent, or Firm* — The Law Firm of Andrea Hence Evans, LLC

(57) ABSTRACT

An adjustable bed skirt for use between a mattress and a box spring that is comprised of a top strip portion having a vertically extended, downwardly draped side skirt portion connected to the top strip portion outer perimeter edges. Alternatively, the adjustable bed skirt can be attached to an existing bed skirt. The top strip portion is formed by one or more strips, therefore creating a bed skirt simple to install, adjust, and remove. The top strip portion has a left strip, right strip and a foot strip. An outer edge extends along an outside of the left strip, right strip and foot strip and an inner edge extends along an inside of the left strip, right strip and foot strip. The width of the top strip portion and a height of the side skirt portion is adjustable when the elastic portions are expanded or retracted.

15 Claims, 2 Drawing Sheets

ADJUSTABLE BED SKIRT

RELATED APPLICATIONS

The present application is a non-provisional application of provisional U.S. Application No. 61/377,890, filed Aug. 27, 2010, the entirety of which is incorporated herein by reference.

FIELD OF THE INVENTION

The present invention relates generally to bedding. More particularly to an adjustable bed skirt having flexible strips that provide more stable placement between a mattress and a box spring without needing to first remove the mattress.

BACKGROUND OF THE INVENTION

Dust ruffles or bed skirts are pieces of cloth used to prevent dust from collecting under a bed. Installing traditional bed skirts typically requires two persons because removal of the mattress is often far too heavy for a single person to remove alone. The difficulties of installing a bed skirt are often multiplied because traditional bed skirts are not formed to fit to the box spring but are oversized creating an additional need to lift the heavy mattress and re-fit. The traditional bed skirt is difficult to use and decreases the likelihood of wanting to clean, change or even use a bed skirt.

SUMMARY OF THE INVENTION

This invention introduces an adjustable bed skirt constructed with support strips which have integral elastic sewn in the foot strips to enhance the stability and adjustability of the bed skirt.

An aspect of an embodiment of the invention provides the top strip portion of the bed skirt can be employed as a stencil to convert the design of any existing bed skirt from a traditional bed skirt to an adjustable bed skirt.

A further aspect of an embodiment of the invention provides the adjustable bed skirt featuring a nonslip and flexible material affording the bed skirt to be easily positioned and removed by a user.

A further aspect of an embodiment of the invention provides the adjustable bed skirt having height and/or width adjustment.

Additional aspects, objectives, features and advantages of the present invention will become apparent from the following description of the preferred embodiments with reference to the attached drawings.

DETAILED DESCRIPTION OF THE INVENTION

Figure 1:
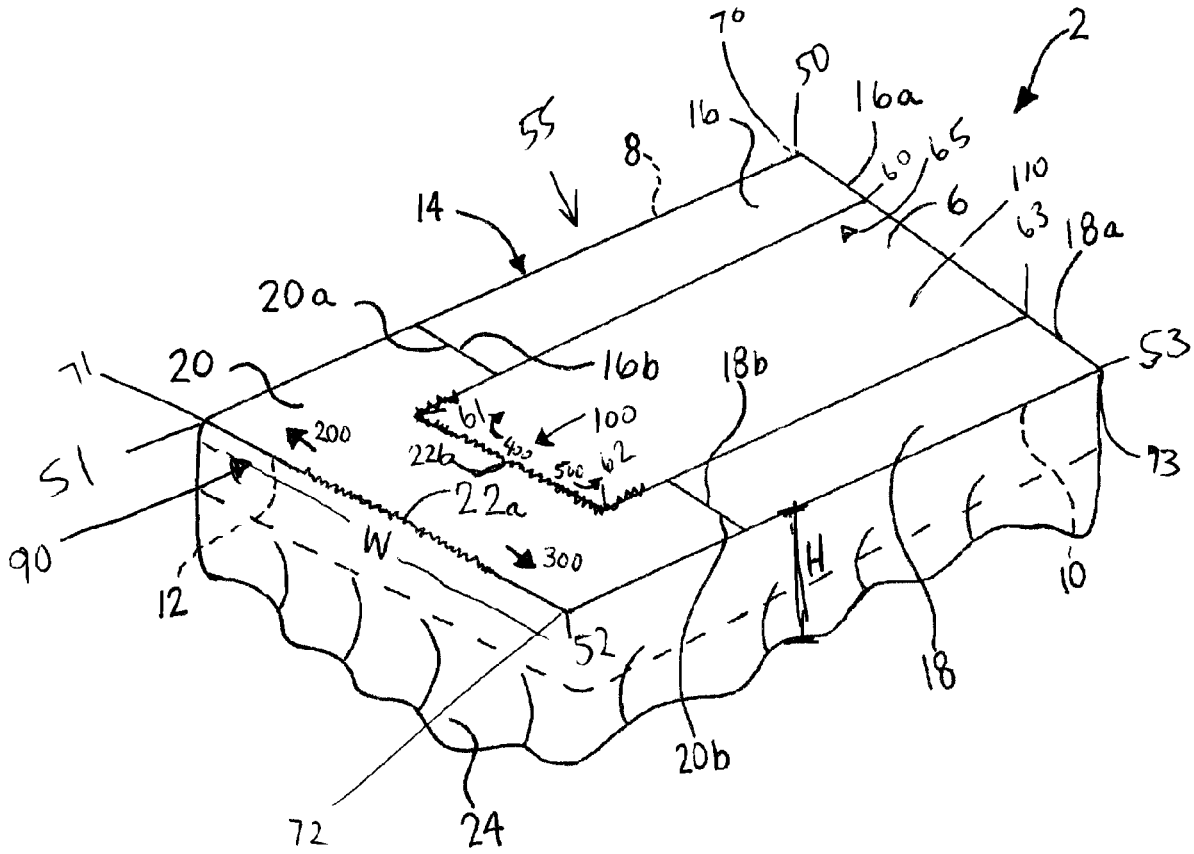
FIG. 1 is a perspective view of one embodiment of an adjustable bed skirt according to the present invention, installed over a box spring.

Referring now to the drawings, wherein like reference numerals represent the same parts throughout, FIG. 1 illustrates a first embodiment of an adjustable bed skirt 2 of the present invention for use between a mattress (not shown) and a box spring 6. An adjustable bed skirt 2 in accordance with one embodiment comprises a top strip portion 14 having an outer edge 55. The outer edge 55 is joined to the vertically extended, downwardly draped side skirt portion 24 installed on a portion of the foot surface 12 and respective side surfaces 8 and 10 of box spring 6. The outer edge is an outside limit extending around a first left strip corner 50 to the first outside corner 51 to the second outside corner 52 to the first right strip corner 53.

FIG. 1 illustrates an adjustable bed skirt 2 installed on a portion of the foot surface 12 and respective side surfaces 8 and 10 of box spring 6, to encompass the construction and use of the said invention. An adjustable bed skirt 2 is comprised of two portions; a top strip portion 14 formed of one or more strips: left strip 16, right strip 18, and foot strip 20, and a side skirt portion 24. The outer perimeter edges 70,71,72, and 73 of the top strip portion 14 are joined to the vertically extended, downwardly draped side skirt portion 24 of the adjustable bed skirt 2.

In further detail still referring to the present invention in FIG. 1, the construction details of the top strip portion 14 are formed by one or more flexible strips using, non-traditional, nonslip, and advantageously flexible material to be slid in between a mattress (not shown) and a box spring 6. Each strip of the top strip portion 14 is made from an ultra firm stability enhanced material. Preferably, the stability enhanced material is Pellon® Peltex® 70, which is a product of Pellon®, manufactured specifically by Pellon® Consumer Products. Through extensive experimentation, it has been determined that for reasons of ease of use, enhancement and natural stability, this product is preferred to provide excellent results with how the said invention is to be used, but is not limited to. Those skilled in the art will understand that the top strip portion 14 in FIG. 1 of the present invention is not limited with respect to the recommended material to be used.

Furthermore, the construction details of the present invention as shown in FIG. 1 illustrate that each of the non-slip, flexible strips 16, 18, and 20 are joined by conventional sewing and stitching processes to form the top strip portion 14. Conventional sewing and stitching means are well known. Those skilled in the art will understand the manner in which the adjustable bed skirt 2 of the present invention can be manufactured using such sewing and stitching processes or other known attachment mechanisms.

There are two left strip ends 16*a* and 16*b*, two right strip ends 18*a* and 18*b* and a first foot strip end 20*a* and a second foot strip end 20*b*. Strip ends 16*a* and 18*a* are free ends that lay atop the head of the box spring 6. It is recommended but not limited to, that ends 16*a* and 18*a* be zip sewn to provide a more finished look. The left strip end 16*b* is joined to the foot strip end 20*a*; and right strip end 18*b* is joined to foot strip end 20*b* by conventional sewing and stitching means. The top portion 14 also features an inner edge 65. The inner edge 65 is an inside limit extending around a second left strip corner 60 to the first inside corner 61 to the second inside corner 62 to a second right strip corner 63.

In further detail, still referring to FIG. 1, the joining of the strip ends provide all strips 16, 18, and 20 to be a length that respectively spans a portion of the foot surface 12 and respective side surfaces 8 and 10 of box spring 6, creating one single half rectangular or squared "U" shape construction. Because the present invention is designed to only partially cover the upper platform of box spring 6, the top strip portion 14 requires less material than traditional bed skirts that generally cover the entire upper platform of a box spring, thereby reducing manufacturing costs. Both strips 16 and 18 expand along opposite sides of the box spring 6; and strip 20 expands along the foot 12 and partially along both the left and the right side surfaces 8 and 10 of box spring 6. By expanding strip 20 partially along both the left and the right side surfaces 8 and 10 of box spring 6 creates a natural reinforced stability for both the left strip 16 and the right strip 18 when in use. The top strip portion 14 is simply inserted between the mattress and the box spring to overlie only along the outer perimeter of the box spring. The design and strategic insertion of elastic, creates additional stability with a natural support feature, supported by the weight from the heavy mattress.

Furthermore, the design of the top strip portion 14 of the said invention has an additional beneficial feature wherein insertion of a first sewn-in elastic 22*a* and second elastic portion 22*b* at strategic center points of the foot strip 20 allows easy adjustment of the width of the top strip portion 14 and height of the side skirt portion 24 to be adjustable when slid in place between a mattress (not shown) and box spring 6. The sewn-in elastic allows stability of the entire structure, and further serves as a natural support feature to totally eliminate the need for any type of fasteners, hooks, pins, strips, Velcro, zippers, etc. to be used with the top strip portion 14, and therefore provides ease of use and further reduced manufacture costs. The first elastic 22*a* is proximately centered between the first outside corner 51 and the second outside corner 52. The first elastic portion 22*a* is along the outer edge 55 on the foot strip 12. Furthermore, the first inside corner 61 and a second inside corner 62 on the inside of the foot strip 12 features a second elastic portion 22*b* at an area between the first and second inside corners. The second elastic portion 22*b* is along the entire inner edge 65 of the foot strip 12 and extends from the first inside corner 61 upwards along the edge to a towards a first foot strip end 20*a* and from the second inside corner 62 upwards along the edge towards a second foot strip end 20*b*. The second elastic portion 22*b* is extended along the edge about 0.5 inches from the corners 61 and 62 to towards their respective ends 20*a*, 20*b*. The second elastic portion 22 provides further expansion of the bed skirt 2 and adds extra reinforcement to the top portion 14. The first elastic portion 22*a* and the second elastic portion 22*b* are parallel along the outer foot portion edge 90 which is the edge between corners 51 and 52 and the inner foot portion edge 100 which is the edge between corners 61 and 62. First elastic portion 22*a* is sewn onto the seam of the skirt and attached top portion 14 on the first outer edge 90. The second elastic portion 22*b* is sewed or attached to the inner foot portion edge 100 and along the edges towards ends 20*a*, 20*b*. The top portion 14 and connected skirt 24 can be expanded in directions shown by arrows 200, 300, 400 and 500 when a pulling force is applied to the bed skirt 2.

In addition to the above described construction details of the present invention there is shown a decorative flexible side skirt portion 24 that is joined to the outer perimeter edges of the top strip portion 14, to make one complete embodiment of an adjustable bed skirt 2. The side skirt portion 24 is joined to the top strip portion 14 by joining together in a continuous line of stitching with conventional sewing and stitching means. The side skirt portion 24 is fabricated from a decorative material that is joined and extends vertically from the top strip portion 14 outer perimeter edges to cover the left, right, and foot sides of box spring 6.

The side skirt portion 24 extends vertically just above reaching the floor. It is recommended but not limited to, that the side skirt portion 24 design provide left and right corner slits or gaps to allow manual adjustment of the side skirt portion 24 when in use. Furthermore, the side skirt portion 24 is fabricated from various decorative materials and shaped into a ruffled, tapered, or pleated design, and various other designs to enhance the aesthetic appeal.

Figure 2:
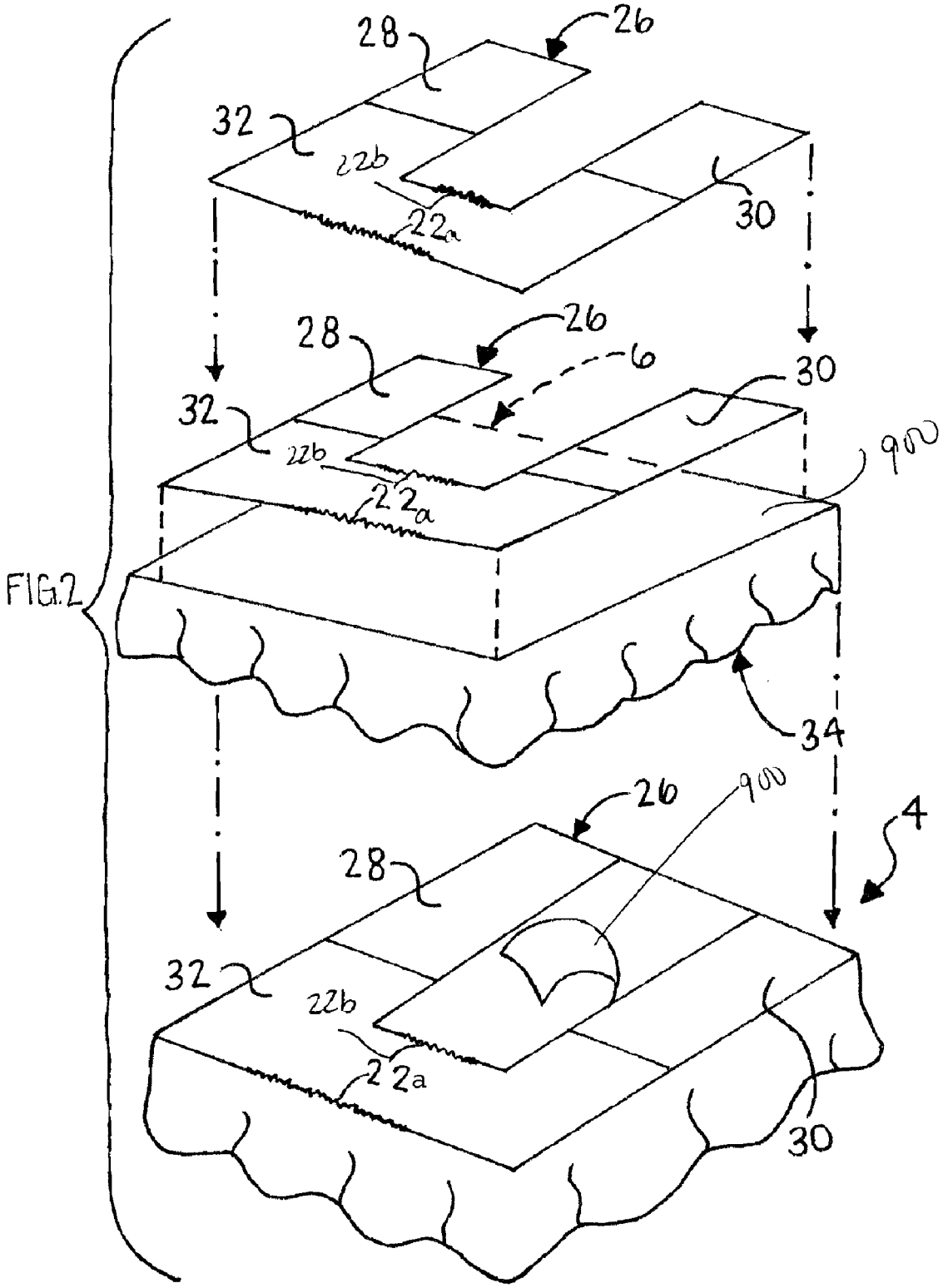
FIG. 2 is an exploded view of an alternative embodiment of an adjustable bed skirt top portion according to the present invention, installed over a box spring.

FIG. 2 illustrates another embodiment of the present invention wherein the top strip portion 26 is installed on a box spring 6 independently from the side skirt portion 24 as outlined above. The top strip portion 26 comprising strips 28, 30 and 32 in FIG. 2 are constructed and manufactured identically to the manner in which the top strip portion 14 in FIG. 1 comprising strips 16, 18 and 20 are manufactured, except that the side skirt portion 24 is not attached. Top strip portion 26 in FIG. 2 can be used as an adhesive stencil instead of a top strip portion 14 as outlined above in FIG. 1. Top strip portion 26 is employed as a stencil to convert any original or traditional bed skirt 34 to an improved adjustable bed skirt 4. The top strip portion 26 in FIG. 2 preferably is identical to the top strip portion 14 shown in FIG. 1 in all other respects.

However, the preferred material for the top strip portion 14 in FIG. 2 is made of an adhesive material Pellon® Peltex® 71F, which is a product of Pellon®, manufactured specifically by Pellon® Consumer Products. Through extensive experimentation, it has been determined that for reasons of ease of use, enhancement and natural stability, this product is preferred to provide excellent results with how the said invention is to be used, but is not limited to. Those skilled in the art will understand that the top strip portion 14 and 26 in FIGS. 1 and 2 of the present invention is not limited with respect to the recommended material to be used. Any material that is ultra firm, smooth, and can act as a heavy weight stabilizer may be used.

In accordance to the embodiment of the present invention it is usable in various different ways and with multiple sized box springs that are of standard sizes (twin, full, queen, king, California king) and irregular size box springs. With one respect to how an adjustable bed skirt 2 is to be employed as shown in FIG. 1, each strip of the top strip portion 14 is of a desired width and design to ensure they naturally remain stable when simply slid in place between a mattress and a box spring.

To arrange an adjustable bed skirt 2 on a mattress and box spring 6 the method provides holding either strip end 50, 51, 52, 53 and begin at any desired corner of the mattress and box spring. Then, the top strip portion 14 is placed on a top surface 110 of the box spring. The top strip portion 14 is slid to desired depth of insertion between the mattress and box spring without the need to remove the heavy mattress. The top strip portion 14 is moved around each corner of the mattress and box spring while sliding the remaining strips in between the mattress and box spring to ultimately end with a top strip portion 14 of an adjustable bed skirt 2 installed between a mattress and box spring that lay atop a portion of the foot surface and respective side surfaces of a box spring and a side skirt portion 24 that covers the left, right, and foot sides of the box spring, as shown in FIG. 1. To adjust the height or drop of the side skirt portion 24, a pulling force is applied to the top strip portion's foot strip 20 at its corners 51, 52 or 61, 62 to expand the width or selectively vary the depth of insertion of the left strip 16 and right strip 18 slid between the mattress and box spring. To remove an adjustable bed skirt 2, simply slide out from between the mattress and box spring. When the complete embodiment of the said invention is in use the end result provides an advantageously simple adjustable bed skirt 2 capable of easy height H and width W adjustment, and simple slide in installation and slide out removal without the need for help from another person to first remove the mattress which is often far too heavy for a single person. The bottom portion of the bed skirt 2 contacts the top surface of the box spring 6 and the top surface of the bed skirt 2 contacts the bottom side of the mattress.

With another respect to how the present invention is to be employed, the top strip portion 26 shown in FIG. 2 is employed as a stencil to convert the design of any existing bed skirt from a traditional bed skirt to an improved adjustable bed skirt 4. The method to convert the design of any existing bed skirt from a traditional bed skirt 34 to an improved adjustable bed skirt 4 is shown in FIG. 2. The top strip portion 26 is placed over the platform surface fabric of any original or traditional bed skirt. Then, the top strip portion 26 is covered with a damp press cloth. Using a hot steam iron at wool setting or another heat applicator, press firmly for 2-16 seconds using a gliding motion and slight pressure to iron and adhere the top strip portion 26 to the platform surface fabric of the original or traditional bed skirt 34. Repeat lifting and overlapping until all fabric is fused to the platform surface fabric of the original or traditional bed skirt 900. Remove press cloth and iron fabric to eliminate excess moisture. Lastly, cut away excess fabric 900 from the platform surface of the original or traditional bed skirt to provide a finished advantageously simple adjustable bed skirt 4 capable of easy height and width adjustment and simple slide in installation and slide out removal without the need for help from another person to first remove the mattress which is often far too heavy for a single person.

After a traditional bed skirt has been converted to an adjustable bed skirt 4 by using top strip portion 26, of the present invention as a stencil the installment, adjustment, and removal is generally the same as described in the above steps for inserting the top strip portion 26 between a mattress and a box spring.

The bed skirt is readily interchangeable and can be installed over traditional bed skirts as well as other bed skirts to provide a layered effect which enhances décor and aesthetic appeal.

The invention has been described in detail with particular reference to certain preferred embodiments thereof, but it will be understood that variations and modifications can be effected within the spirit and scope of the invention.

The invention is claimed is:

1. A bed skirt comprising:

a top strip portion having a left strip, right strip and a foot strip, an outer edge along the left strip, right strip and foot strip, wherein a side skirt portion extends downwardly from the outer edge;

wherein the foot strip comprises a first outside corner and a second outside corner having a first elastic portion at a proximate center area between the first outside corner and the second outside corner, a first inside corner and a second inside corner on the inside of the foot strip having a second elastic portion between the first and second inside corners wherein the second elastic portion is along the inner edge on the foot strip, whereby the width of the top strip portion and a height of the side skirt portion is adjustable when the elastic portion is expanded or retracted.

2. The bed skirt of claim 1, wherein the left strip, right strip and foot strip are joined to form a U-shape.

3. The bed skirt of claim 1, wherein the outer edge is an outside limit extending around a first left strip corner to the first outside corner to the second outside corner to the first right strip corner.

4. The bed skirt of claim 3, wherein the elastic portion is along the outer edge on the foot strip.

5. The bed skirt of claim 1, wherein the side skirt portion is ruffled, tapered or pleated.

6. A bed skirt comprising:

a top strip portion having a left strip, right strip and a foot strip, an outer edge along an outside of the left strip, right strip and foot strip, an inner edge along an inside of the left strip, right strip and foot strip, wherein a side skirt portion extends downwardly from the outer edge;

wherein the foot strip comprises a first outside corner and a second outside corner having a first elastic portion at a first proximate center area between the first and second outside corners and a first inside corner and a second inside corner on the inside of the foot strip having a second elastic portion between the first and second inside corners, wherein the second elastic portion is along the inner edge on the foot strip, whereby the width of the top strip portion and a height of the side skirt portion is adjustable when the elastic portion is expanded or retracted.

7. The bed skirt of claim 6, wherein the outer edge is an outside limit extending around a first left strip corner to the first outside corner to the second outside corner to the first right strip corner.

8. The bed skirt of claim 7, wherein the first elastic portion is along the outer edge on the foot strip.

9. The bed skirt of claim 6, wherein the inner edge is an inside limit extending around a second left strip corner to the first inside corner to the second inside corner to a second right strip corner.

10. The bed skirt of claim 9, wherein the second elastic portion is along the inner edge of the foot strip.

11. The bed skirt of claim 6, wherein the first elastic portion and the second elastic portion are parallel.

12. The bed skirt of claim 6, wherein the side skirt portion is ruffled, tapered or pleated.

13. A bed skirt comprising:

a top strip portion having a left strip, right strip and a foot strip, an outer edge along an outside of the left strip, right strip and foot strip, an inner edge along an inside of the left strip, right strip and foot strip, wherein the foot strip comprises a first outside corner and a second outside corner having a first elastic portion at a first proximate center area between the first and second outside corners and a first inside corner and a second inside corner on the inside of the foot strip having a second elastic portion between the first and second inside corners wherein the second elastic portion is along the inner edge on the foot strip and extends from the first inside corner towards a first foot strip end and from the second inside corner towards a second foot strip end.

14. The bed skirt of claim 13, wherein the first elastic portion is along the outer edge on the foot strip.

15. The bed skirt of claim 13, further comprising a bottom portion of the top strip portion applied to a top of a traditional bed skirt converting the traditional bed skirt to be adjustable.

* * * * *